US006352115B1

(12) United States Patent
Mathieu

(10) Patent No.: US 6,352,115 B1
(45) Date of Patent: Mar. 5, 2002

(54) DEVICE FOR FITTING AN OIL PIPE STIFFENING SLEEVE ON A SUPPORT STRUCTURE

(75) Inventor: Patrice Raymond Mathieu, Lyons (FR)

(73) Assignee: Coflexip (FR)

( * ) Notice: Subject to any disclaimer, the term of this patent is extended or adjusted under 35 U.S.C. 154(b) by 0 days.

(21) Appl. No.: 09/423,996

(22) PCT Filed: Jun. 24, 1999

(86) PCT No.: PCT/FR99/01522

§ 371 Date: Nov. 17, 1999

§ 102(e) Date: Nov. 17, 1999

(87) PCT Pub. No.: WO00/01920

PCT Pub. Date: Jan. 13, 2000

(30) Foreign Application Priority Data

Jul. 2, 1998 (FR) ..... 98 08467

(51) Int. Cl.[7] ..... E21B 15/02

(52) U.S. Cl. ..... 166/352; 405/224.2; 205/382

(58) Field of Search ..... 166/344, 345, 166/360, 367, 352; 114/230.12; 441/3–5; 405/224.2, 224.3; 205/316, 123.11, 123.9, 382.7, 382

(56) References Cited

U.S. PATENT DOCUMENTS 2,628,111 A * 2/1953 Smalline ..... 285/382.7
3,496,898 A 2/1970 Morgan
4,185,694 A 1/1980 Horton
4,516,881 A 5/1985 Beynet et al.
5,517,937 A * 5/1996 Lunde ..... 114/230
5,683,205 A 11/1997 Halkyard
5,947,642 A * 9/1999 Teixeira et al. ..... 405/195.1

FOREIGN PATENT DOCUMENTS

| | | |
|---|---|---|
| EP | 0565445 | 10/1993 |
| FR | 9703095 | 4/1999 |
| GB | 2259127 | 3/1993 |
| GB | 2317631 | 4/1998 |

* cited by examiner

*Primary Examiner*—David Bagnell
*Assistant Examiner*—John Kreck
(74) *Attorney, Agent, or Firm*—Ostrolenk, Faber, Gerb & Soffen, LLP

(57) ABSTRACT

A device for fitting a stiffening sleeve which is located at the end of an oil pipe onto a bearing structure. The device comprises an internal hollow tube fixed on the bearing structure, the tube having an internal diameter slightly greater than the diameter of the cylindrical wall of the stiffener, and two support/centering devices, respectively a lower device formed by retractable balls and an upper device formed by a conical collar, the devices interacting with the cylindrical wall of the stiffener and a conical bearing surface at the top of the tube in order to support/center the stiffener.

15 Claims, 5 Drawing Sheets

DEVICE FOR FITTING AN OIL PIPE STIFFENING SLEEVE ON A SUPPORT STRUCTURE

BACKGROUND OF THE INVENTION

The present invention relates to a device for fitting an end of an oil pipe on a bearing structure, in particular a platform or a vessel, the end comprising a wall which is substantially cylindrical or conical in the area of the part to be fitted. In a typical but not limiting example of application, the end is formed by a stiffening sleeve comprising a sheath forming the above mentioned substantially cylindrical wall.

The stiffening sleeves or stiffeners used to limit the bending of a flexible pipe are well known, and reference may be made, for example, to the Applicant's patents EP 0,565,445 A and FR 97 03 095.

When a flexible pipe, fitted with a stiffening sleeve and an end fitting, is winched onto a platform to be fixed there by fitting, it is necessary for the fitting device to be constructed to resist powerful stresses, comprising firstly the axial loads resulting from the weight of the submerged pipe and also, in particular, bending stresses acting on the stiffening sleeve, which stresses result in particular from the oceanic currents and the swell. It is necessary for these stresses to be appropriately absorbed in the fitting device.

The Applicant's hitherto-known devices make use of bulky bolted assemblies, although space is a critical problem on platforms. Furthermore, the operation of connecting the assembly of pipe, device and bearing structure is made complex and time-consuming. In a particular example of a known device, the stiffening sleeve comprises a broad flange at its end which is passed through an aperture in the bearing structure, after which two thick plates are slid under the flange. The plates straddle a base solidly fixed to the bearing structure. Then the plates are bolted to the base and the flange screwed to the plates, bolts and screws being prestressed.

Moreover, document U.S. Pat. No. 5,683,205 has disclosed an intervening sleeve system making it possible to relieve stress on a pipe passing through an aperture in a floating structure by distributing the forces, in particular bending forces, over the pipe. This system is not intended either to fix a submerged pipe at one end or to bear the weight thereof.

Finally, document GB 2 317 631 has disclosed a floating system for guiding a riser, making it possible in particular to guide the riser in accordance with a vertical axis. This is therefore certainly not a device for fitting an end of an oil pipe.

SUMMARY OF THE INVENTION

The object of the invention is to propose an effective and compact fitting device.

The invention achieves its object by virtue of a device for fitting an end—and in particular a stiffening sleeve—of a submerged oil pipe onto a bearing structure forming part of a platform or vessel. The end region includes a wall that is substantially cylindrical or conical in the area of the part to be fitted, and further it comprises a substantially cylindrical or conical hollow tube fixed on the bearing structure. The hollow tube has an internal diameter that is slightly greater than the outer diameter of the said cylindrical or conical wall. Two support/centering devices, a lower and an upper device respectively, are provided at the bottom and the top of the tube to interact with the wall of the pipe end region in order to support the weight of the submerged pipe and center the end or sleeve. The end is winched, in a manner known per se, until its wall is within the tube, the slightly greater dimensions of the tube and the advantageous presence of an intake funnel allow this maneuver. Because the two support/centering devices are situated some distance apart, it is possible correctly to align the end with the axis of the tube and to hold it there solidly, using the lever arm to counter the effects of the bending stress which constitutes the most critical point. As indicated, the wall of the end may be substantially cylindrical or conical, and may or may not comprise shoulders, and the tube is substantially complementary. However, it may be advantageous to allow for a little more play in the area of one of the support/centering devices; for example, in the context of a substantially cylindrical arrangement. It is nevertheless possible to arrange for the diameter of the wall to be slightly greater at the bottom, so as to reduce play there and hence reduce the size of the support/centering device while allowing easy entry of the end into the tube.

One of the support/centering devices, and preferably the upper device, is formed by at least one conical member that interacts with a shoulder provided on the end of the pipe and with a conical bearing surface provided on the said tube. The conical members may be separate members distributed circumferentially or, preferably, be formed by a two-part collar. Advantageously, the conical bearing is provided at the upper end of the said tube, and the conical collar rests there, providing both a support and a degree of centering and alignment with the axis. The shoulder provided on the end is advantageously formed by the upper edge of an annular groove formed in the cylindrical wall and partially seating the conical collar.

The other or lower one of the said support/centering devices is advantageously formed by retractable projections, distributed circumferentially (and preferably at least three in number), provided in the inner wall of the tube and capable of being forced radially inwards into contact with the cylindrical wall of the end. In a possible embodiment, each projection is formed by a pin, in one or more parts, seated radially in a radial hole in the tube, which pins are individually forced radially inwards against the tube, for example by means of a thread provided in the radial hole and on the rear part of the pin, which then forms a pressure screw. In another embodiment, each retractable projection is formed by a ball accommodated in an orifice opening radially into the tube. Advantageously, the forced radial inward movement of the ball is caused by a wedge accommodated in the wall of the said tube. The wedge may be provided at the lower end of a spike accommodated in an inner vertical passage in the wall of the hollow tube. The wedge may be formed by a ramp provided on the spike to act either upwards or downwards. Most advantageously, the movement of the spike may be actuated from the top of the device, which is more easily accessible. The movement of the spikes may be collective or individual. A hydraulic jack mechanism may be associated with each spike.

The material of the ball and that of the wedge are selected so as to limit their deformation during the thrusting of the ball out of its orifice when it acts to create a pressure on the wall of the end of the pipe. The force imparted to the wedge, and therefore to the ball, and the material of the wall of the end of the pipe at the point of contact with the balls are selected either to create a three-dimensional impression in the said wall during installation (in which case a prestress is created) or, on the other hand, to limit such an impression to a negligible depth during maximum stressing. The wall of the end may furthermore comprise, at the point of contact of the balls, a belt made from a different material from the remainder of the wall, harder or softer depending on the desired objective.

The ball-type device thus brings about centering and, in cooperation with the upper device, alignment of the end, at the same time as, by pressure and the embedding of the balls, if any, it provides a firm fixing of the end in the fitting device. Apart from its inherent advantages in terms of compactness and strength, the ball-type device according to the invention has the advantage of not requiring a redundant predetermined axial contact surface with the upper device which would necessitate very strict verification of manufacturing tolerances.

BRIEF DESCRIPTION OF THE DRAWINGS

The invention will be better understood with reference to the description of a particular embodiment which follows, reference being made to the attached drawings, in which.

DESCRIPTION OF A PREFERRED EMBODIMENT

Figure 1:
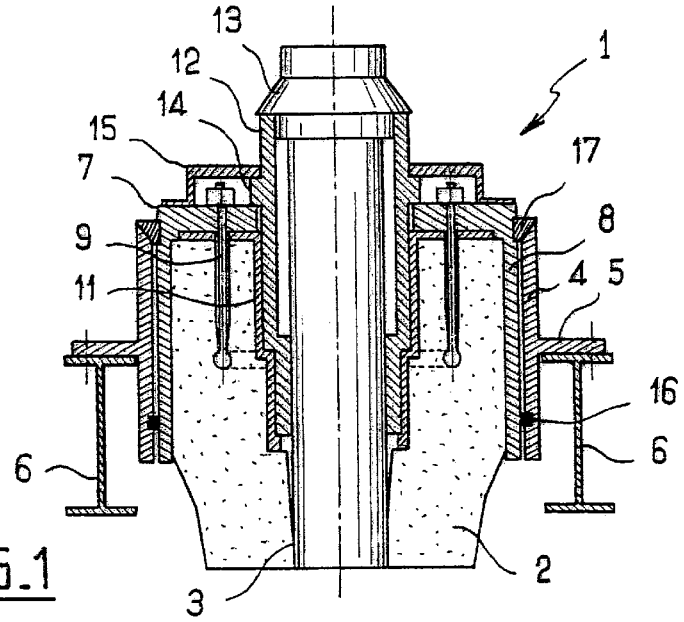
FIG. 1 is a sectional view of the fitting device according to the invention and of the fitted stiffener.
Figure 2:
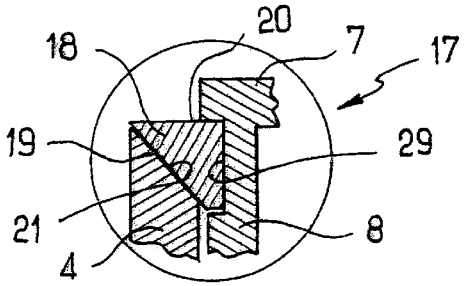
FIG. 2 is a sectional view of the detail of the upper support/centering device of the fitting device.

The fitting device 1 shown is intended to fit the stiffening sleeve 2 which equips the flexible pipe 3. It could also be used to fit an end separate from the stiffening sleeve (for example, situated in the extension thereof) but possessing, like the stiffening sleeve, a substantially cylindrical or conical wall. The device 1 essentially comprises a hollow holding tube 4, comprising, externally, a radial flange 5 by means of which it is fixed to a bearing structure comprising girder members 6 solidly fixed to the deck (not shown) or platform from which the pipe is to be suspended.

The sleeve 2 comprises at its end an annular plate 7, from which emerges a substantially cylindrical sheath 8 covering the periphery of the sleeve 2. The plate 7 is fixed to the sleeve by means of threaded bolts 9 and so locks the rim of an insert 11 of the stiffener. The insert 11 receives the sleeve 12 of the end fitting 13, which sleeve comprises a fixing rib 14 which tightens a fixing clamp 15.

The fitting device 1 according to the invention comprises two support/centering devices, respectively a lower device 16 and an upper device 17.

Figure 2A:
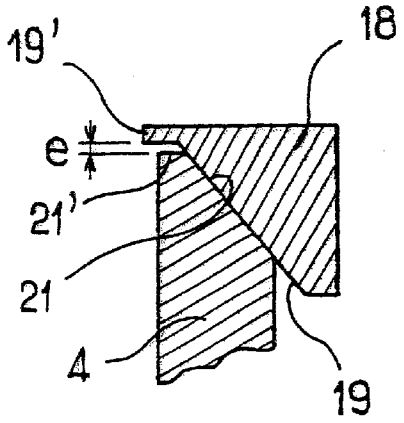
FIG. 2A is being a similar but simplified view showing a modified form of the conical collar.
Figure 4:
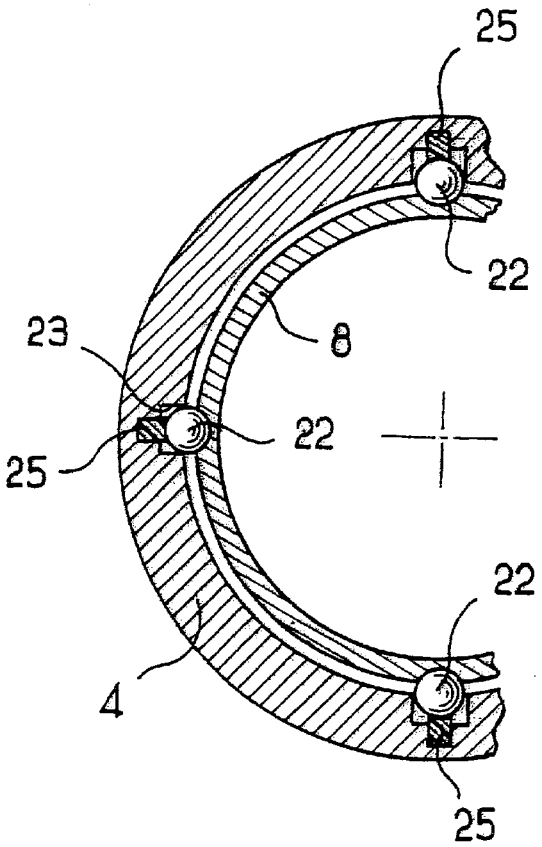
FIG. 4 is a detailed view in semi-cross-section of the lower support/centering device of the fitting device.

The upper device 17 essentially consists of a two-part collar 18 having a conical surface 19. The inner edge 20 of the collar is seated below a shoulder formed by the edge of a peripheral groove 29 made in the upper part of the sheath 7, 8, and the collar bears with its surface 19 against the conical bearing 21 which forms the upper edge of the hollow tube 4. In the modification shown in FIG. 2A, the collar 18 comprises at its periphery, at the level of the conical bearing 19, a rim 19' which interacts with a rim 21' formed at the top of the conical bearing 21 of the tube 4, so as to assist the axial positioning of the collar 18 during its descent onto the tube 4. A play "e" is provided between the rims 19' and 21' in the final position in order not to interfere with the interaction of the bearings 19 and 21.

Figure 3A:
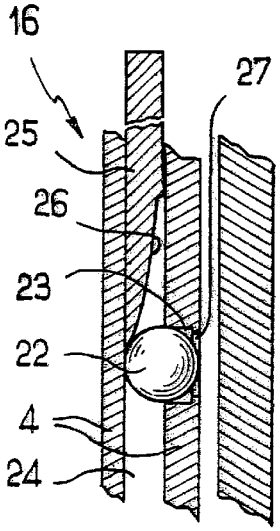
FIGS. 3A, 3B and 3C are sectional detailed views of the lower support/centering device of the fitting device with three successive locking stages.
Figure 3B:
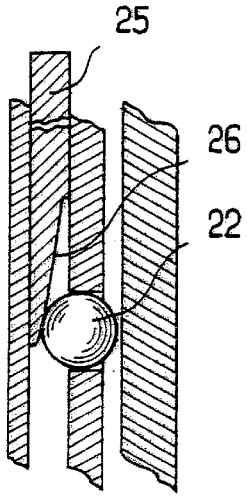
Figure 3C:
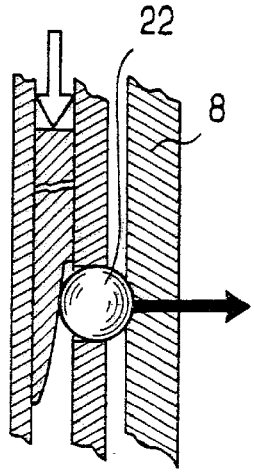
Figure 3D:
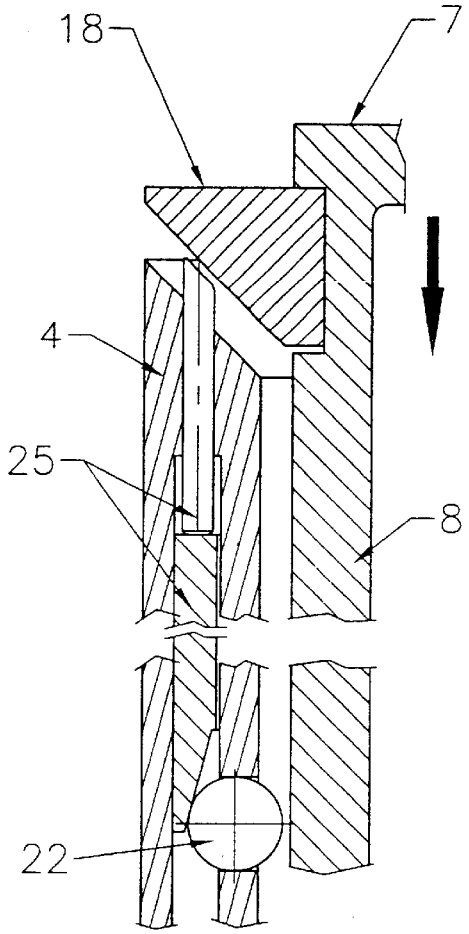
FIGS. 3D and 3E show the upper and the lower centering devices in the stages of FIGS. 3B and 3C respectively.
Figure 3E:
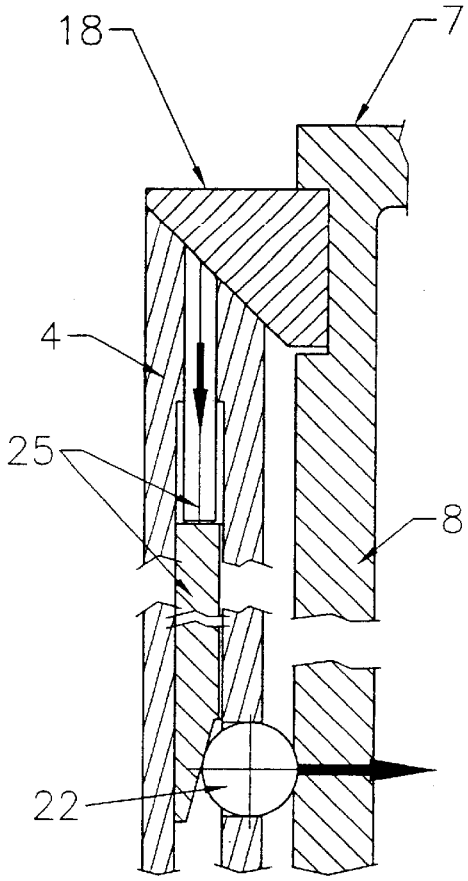

The lower device 16 comprises captive balls 22 (for example, from 3 to 60, distributed circumferentially, the drawing showing only four) accommodated in the wall 4 of the hollow tube in seatings formed by a cylindrical orifice 23 opening radially on one side within the tube 4 and communicating on the other side with a longitudinal passage 24 extending in the wall 4 as far as its upper end. As FIG. 3A shows, the ball seating enables the ball 22 to be held in the retraced position, entirely within the wall 4, in other words without projecting into the inside of the tube. A spike 25 having a wedge-shaped end 26 is accommodated in the passage 24 above the ball 22. When (FIGS. 3B and 3D) the spike 25 is forced in (either by mechanical or hydraulic means or by the actual weight of the pipe transmitted by the collar 18 to the spike heads, as shown in FIG. 3D), the wedge 26 thrusts the ball 22 radially inwards, into the orifice 23 whose diameter is very slightly greater than that of the ball 22, except in the area of a rim 27 intended to prevent the complete escape of the ball 22. As the wedge continues to be forced in, as shown in FIGS. 3C and 3E, the ball 22 increasingly projects into the inside of the tube 4 (at the most, by an amount slightly less than the radius of the ball), and encounters the skirt 8 of the sheath of the sleeve 2, into which it is impressed, if appropriate, by deformation of the skirt, which creates an effective locking of the sleeve in the tube.

Figure 5D:
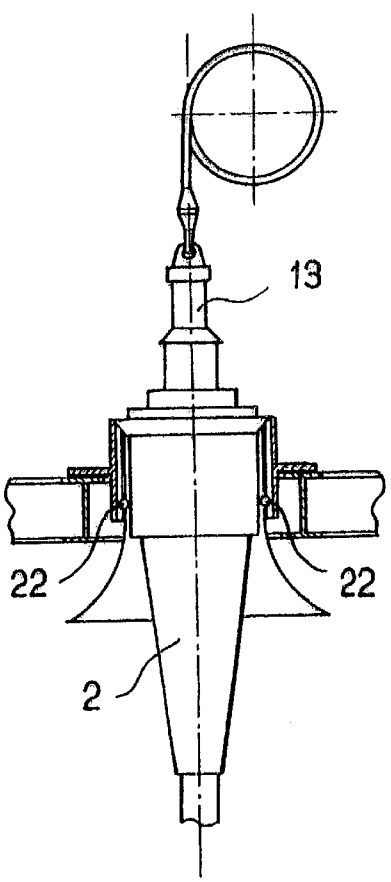
FIGS. 5A, 5B, 5C and 5D are lateral views showing four stages of the introduction of a stiffening sleeve into the fitting device according to the invention.
Figure 5C:
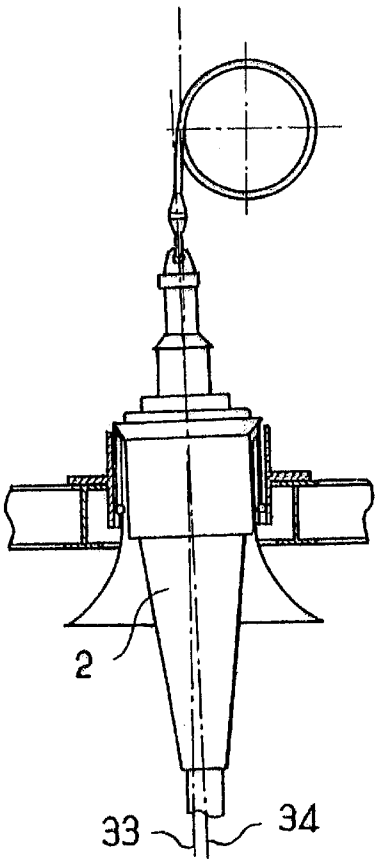
Figure 5B:
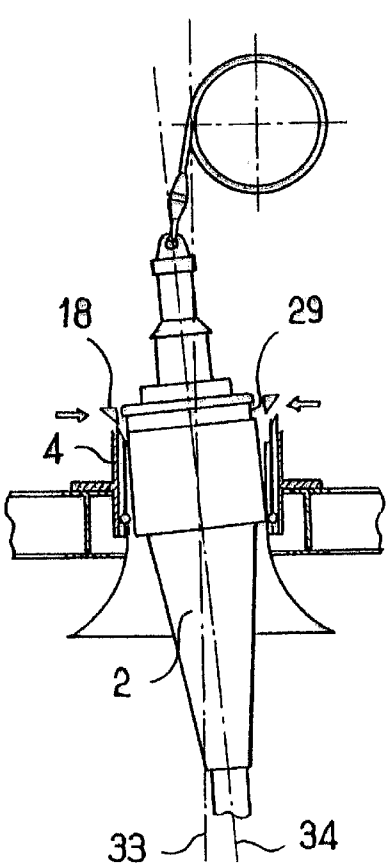
Figure 5A:
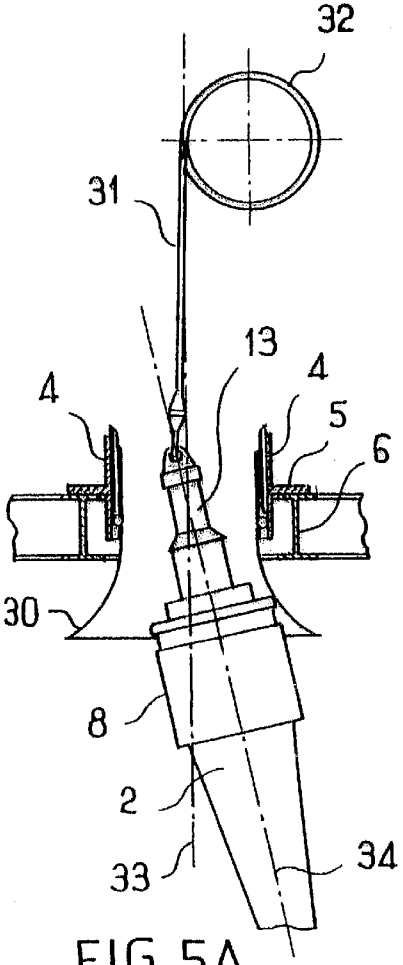

FIGS. 5A to 5D show the approach and locking stages of a sleeve in a stowage tube 4, below which a guide funnel or trumpet 30 has been fixed, as is known per se. The sleeve 2 is hoisted by means of the end fitting 13 and a cable which is wound onto the winch 32 (FIG. 5A). As a result of the fact that the balls 22 are retracted into the wall of the hollow tube 4, the skirt 8 of the sleeve 2 can pass unobstructed into the said tube, until the rib 29 projects out of the tube 4 (FIG. 5B) and the two-part collar 18 can be installed. The sleeve 2 can then rest, supported by the said collar 18, on the conical end bearing 19 of the tube 4, the axis 34 of the sleeve being in a position increasingly approaching the axis 33 of the tube 4 (FIG. 5C). Coaxiality and final fixing are obtained in the final phase (FIG. 5D) where the wedged spikes 25 are forced into their respective passage and force the balls 22 radially inwards against and, optionally, partly into the skirt 8 of the sleeve 2. To facilitate the operations, the bottom edge of the tube 4 and top edge of the sheath are chamfered or rounded.

The upper support/centering device 17 provides for the absorption of the axial forces and bending stresses, while the lower support/centering device provides for the absorption of the shear forces and bending stresses.

Figure 6:
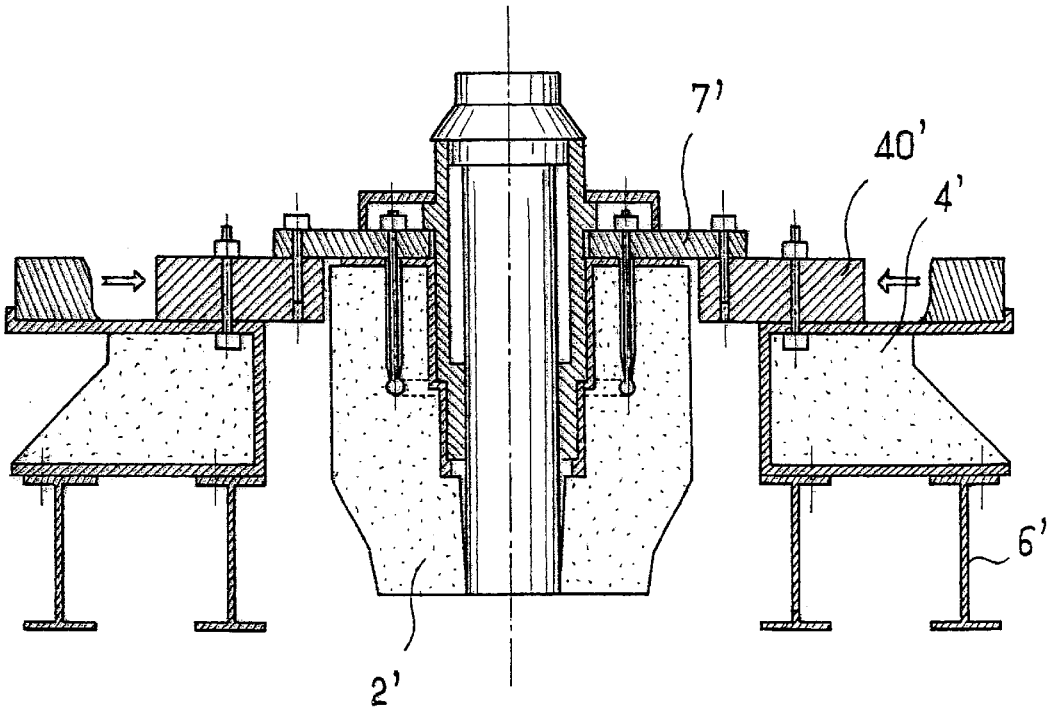
FIG. 6 PRIOR ART
FIG. 6 is a view similar to FIG. 1 of a fitting device of the prior art.

FIG. 6 shows, for the purposes of comparison, a fitting device according to the prior art. The sleeve 2' comprises a broad flange 7' bolted onto two thick plates 40' which have been slid beneath them and which are themselves bolted to a base 41' connected to the bearing structure 6'.

I claim:

1. A device for fitting an end region of a submerged oil pipe onto a bearing structure, wherein the end region includes a rigid, substantially cylindrical or conical wall in the area of the bearing structure onto which the pipe is to be fitted, the device comprising a substantially hollow tube to be fixed on the bearing structure, the tube being sized for surrounding the wall of the pipe and the tube having an internal profile that is slightly greater than the external profile of the pipe wall;

a lower support/centering device at the bottom of the tube; and a separate upper support/centering device spaced above the lower device and at the top of the tube, the support/centering devices being operable to interact with the wall in order to support the weight of the submerged pipe and also to center the end of the pipe, the operation of the lower support centering device being triggered by the operation of the upper support centering device.

2. Device according to claim 1, wherein a first one of the support/centering devices comprises a conical member arranged for engaging and interacting with a shoulder and a conical bearing surface defined on the tube so as to wedge into a gap defined between the shoulder and the bearing surface.

3. Device according to claim 2, wherein the conical member is a two-part collar (18).

4. Device according to claim 2, wherein the tube has an upper end and the conical bearing surface is provided at the upper end of the tube.

5. Device according to claim 2, wherein the other second one of the support/centering devices comprises retractable projections provided in the tube and being forcible radially inwards into contact with the wall of the pipe end.

6. Device according to claim 5, wherein the first support/centering device is the upper device and the second support/centering device is the lower device.

7. Device according to claim 2, wherein the first support/centering device is the upper device.

8. Device according to claim 1, wherein the device is further arranged for accommodating a stiffening sleeve having a substantially cylindrical sheath on the end of the pipe.

9. Device according to claim 1, wherein the wall of the end region is substantially cylindrical or conical and the hollow tube is correspondingly shaped.

10. A device for fitting an end region of a submerged oil pipe onto a bearing structure, wherein the end region includes a wall in the area of the bearing structure onto which the pipe is to be fitted, the device comprising a substantially hollow tube to be fixed on the bearing structure, the tube being sized for surrounding the wall of the pipe and the tube having an internal profile that is slightly greater than the external profile of the pipe wall;

a lower support/centering device at the bottom of the tube; and a separate upper support/centering device spaced above the lower device and at the top of the tube, the support/centering devices being operable to interact with said wall in order to support the weight of the submerged pipe and also to center the end of the pipe;

wherein a first one of the support/centering devices comprises a conical member arranged for engaging and interacting with a shoulder and a conical bearing surface defined on the tube so as to wedge into a gap defined between the shoulder and the bearing surface;

wherein the other second one of the support/centering devices comprises retractable projections provided in the tube and being forcible radially inwards into contact with the wall of the pipe end; and wherein each retractable projection comprises a ball, and an orifice opening radially into the tube and receiving and supporting the ball for radial movement.

11. Device according to claim 10, further comprising a wedge seated in the tube and movable along the tube to engage the balls and to force radially inward movement of the balls.

12. Device according to claim 11, further comprising an inner vertical passage in the wall of the hollow tube and the wedge being provided at the lower end of a spike and the spike being movable along the tube.

13. Device according to claim 12, wherein the wedge may be actuated from the upper part of the device.

14. A device for fitting an end region of a submerged oil pipe onto a bearing structure, wherein the end region includes a wall in the area of the bearing structure onto which the pipe is to be fitted, the device comprising a substantially hollow tube to be fixed on the bearing structure, the tube being sized for surrounding the wall of the pipe and the tube having an internal profile that is slightly greater than the external profile of the pipe wall;

a lower support/centering device at the bottom of the tube; and a separate upper support/centering device spaced above the lower device and at the top of the tube, the support/centering devices being operable to interact with said wall in order to support the weight of the submerged pipe and also to center the end of the pipe;

wherein one of the support/centering devices comprises retractable projections provided in the tube and being forcible radially inwards into contact with the wall of the pipe end, wherein each retractable projection comprises a ball, an orifice opening radially into the tube and receiving the supporting ball for radial movement, a wedge seated in the tube and movable along the tube to engage the balls and to force radially inward movement of the balls.

15. A device for fitting an end region of a submerged oil pipe onto a bearing structure, wherein the end region includes a rigid, substantially cylindrical or conical wall in the area of the bearing structure onto which the pipe is to be fitted, the device comprising a substantially hollow tube to be fixed on the bearing structure, the tube being sized for surrounding the wall of the pipe and the tube having an internal profile that is slightly greater than the external profile of the pipe wall;

a lower support/centering device at the bottom of the tube; and a separate upper support/centering device spaced above the lower device and at the top of the tube, the support/centering devices being operable from an upper part of the device near said end region to interact with said wall in order to support the weight of the submerged pipe and also to center the end of the pipe.

* * * * *